United States Patent [19]

Imai et al.

[11] Patent Number: 4,588,025

[45] Date of Patent: May 13, 1986

[54] ALUMINUM HEAT EXCHANGER PROVIDED WITH FINS HAVING HYDROPHILIC COATING

[75] Inventors: Takaichi Imai, Uji; Takeshi Yamada, Hirakata; Kunio Sakaue, Kusatsu; Eizo Isoyama, Nara; Masaaki Mizoguchi; Katsumi Tanaka, both of Sakai, all of Japan

[73] Assignee: Showa Aluminum Corporation, Osaka, Japan

[21] Appl. No.: 669,170

[22] Filed: Nov. 7, 1984

[30] Foreign Application Priority Data

Nov. 7, 1983 [JP] Japan ..... 58-209508

[51] Int. Cl.[4] ..... F28F 13/18

[52] U.S. Cl. ..... 165/133

[58] Field of Search ..... 165/133, 134

[56] References Cited

U.S. PATENT DOCUMENTS

| | | | |
|---|---|---|---|
| 3,894,578 | 7/1975 | Stoy et al. | 165/133 X |
| 4,181,773 | 1/1980 | Rickert, Jr. | 165/133 X |
| 4,421,789 | 12/1983 | Kaneko et al. | 165/133 X |

FOREIGN PATENT DOCUMENTS

| | | | |
|---|---|---|---|
| 3011497 | 10/1980 | Fed. Rep. of Germany | 165/133 |
| 26053 | 2/1977 | Japan | 165/133 |
| 153098 | 9/1983 | Japan | 165/133 |
| 208593 | 12/1983 | Japan | 165/133 |

*Primary Examiner*—Sheldon J. Richter

*Attorney, Agent, or Firm*—Armstrong, Nikaido, Marmelstein & Kubovcik

[57] ABSTRACT

The fins of an aluminum heat exchanger are treated with a coating composition comprising an alkali silicate and a low-molecular-weight compound having carbonyl and are thereafter heated for drying, whereby a hydrophilic coating is formed over the surfaces of the fins.

4 Claims, 4 Drawing Figures

ALUMINUM HEAT EXCHANGER PROVIDED WITH FINS HAVING HYDROPHILIC COATING

BACKGROUND OF THE INVENTION

The present invention relates to a heat exchanger made of aluminum and provided with fins which have a hydrophilic coating.

The term "aluminum" as used herein and in the appended claims includes pure aluminum, commercial aluminum containing small amounts of impurities, and aluminum alloys consisting predominantly of aluminum.

Generally with heat exchangers, especially with the evaporators of air conditioning apparatus, the surface temperature of the fins on the tubes falls below the dew point of the atmosphere, so that drops of water adhere to the surfaces of the fins. The deposition of such water drops results in increased resistance to the flow of air, reducing the amount of flow of air and entailing a decreased heat exchange efficiency. This tendency becomes more pronounced when the spacing between the fins is reduced to improve the performance of the heat exchanger and to diminish the size thereof. The heat exchange efficiency is greatly influenced by the wettability of the fin surface with water. When the fin surface has good wettability, the water deposited thereon is less likely to become water drops. This results in reduced resistance to the flow of air and an increased amount of flow of air to achieve a higher heat exchange efficiency. To give improved wettability to fin surfaces, a process has been proposed for forming a coating of water glass (alkali silicate) on the surfaces of aluminum fins (see Published Examined Japanese Patent Application No. 48177/1978). This gives an improved hydrophilic property to the fin initially, but the hydrophilic property becomes impaired early and is not sustainable satisfactorily. Further when the fin material to be shaped is formed with the water glass coating which is hard, cracks develop in bent portions of fins when the material is burred to form the fins, hence poor shapability. The coated material, moreover, is liable to cause wear on the die.

SUMMARY OF THE INVENTION

The main object of the present invention is to overcome the above problems and to provide a heat exchanger made of aluminum and provided with fins which have a hydrophilic coating.

The present invention provides a heat exchanger made of aluminum and comprising a tube and fins attached to the tube, the heat exchanger being characterized in that the fins are treated with a coating composition comprising an alkali silicate A and a low-molecular-weight organic compound B having carbonyl and thereafter dried by heating, whereby a hydrophilic coating is formed over the surfaces of the fins.

Alternatively, a hydrophilic coating is formed on the fin surfaces by treating the fins with a coating composition comprising an alkali silicate A, a low-molecular-weight organic compound B and a water-soluble high-molecular-weight organic compound C.

According to the invention, the coating composition is applied to a thin aluminum plate for forming the heat exchanger fins or a heat exchanger comprising the combination of shaped fins and a tube to form the hydrophilic coating. In the case of a fin material in the form of a thin aluminum plate, the material can be treated and further processed in the form of a flat plate having a specified length, but it is preferable to continuously treat and process the material in the form of a coil.

After the aluminum fins (including shaped fins and fin material before shaping) have been treated with the coating composition, the aluminum fins are dried by heating, whereby a hydrophilic coating is formed.

DETAILED DESCRIPTION OF THE DRAWINGS

Figure 1:
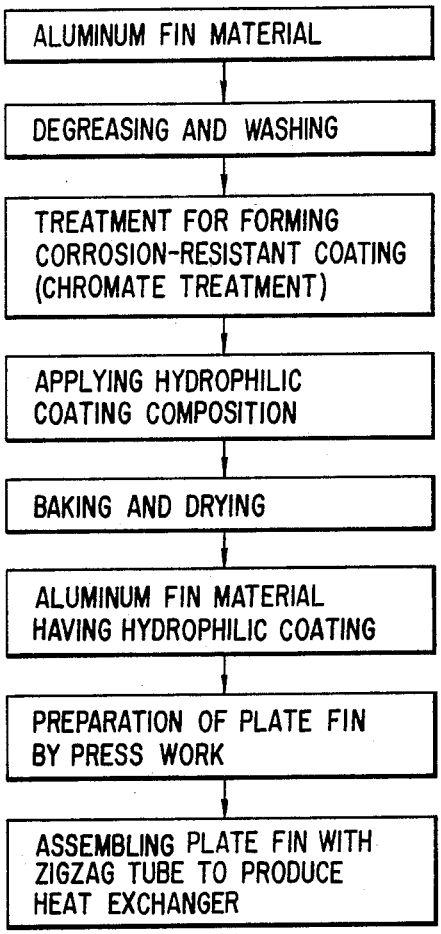
FIG. 1 illustrates a block diagram showing the process of producing a heat exchanger according to the present invention.

FIG. 1 illustrates by way of a block diagram the process for producing the heat exchanger of the present invention. Each block illustrates a step in the process beginning with the aluminum fin material and ending with assembling the plate fin with a zigzag tube to produce the heat exchanger. The steps are clearly described in the example that follow.

Figure 2:
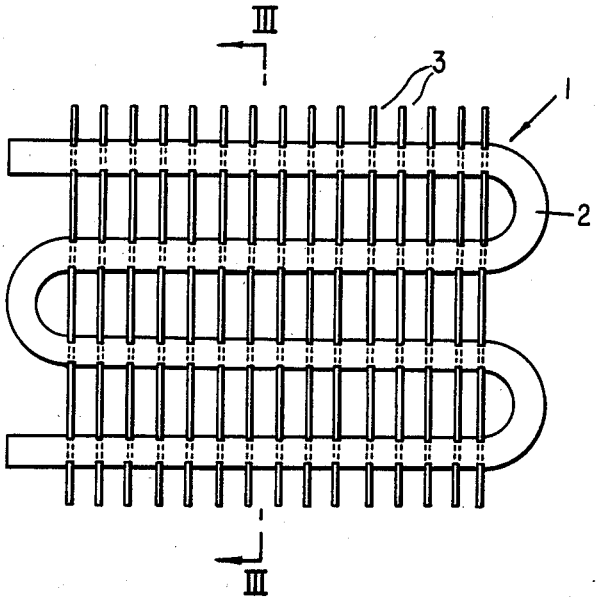
FIG. 2 shows a schematic front view of a heat exchanger according to the present invention.

FIG. 2 shows a front schematic view of a preferred embodiment of the present invention wherein 1 indicates a heat exchanger. The zigzag tube 2 is assembled with plate fins 3 to produce the heat exchanger.

Figure 3:
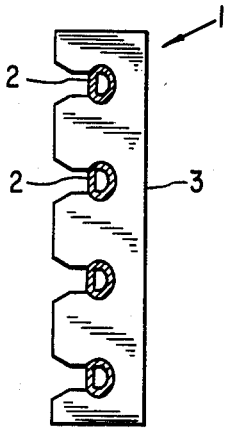
FIG. 3 shows an enlarged sectional view of a heat exchanger according to the present invention taken along the line III—III of FIG. 2.

FIG. 3 shows a sectional view of a heat exchanger according to the present invention illustrating the arrangement of the zigzag tube 2 and a plate fin 3.

Figure 4:
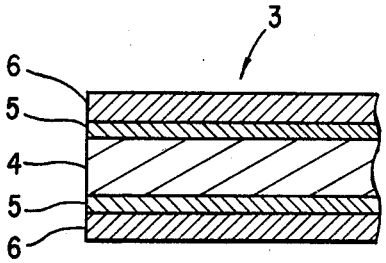
FIG. 4 shows an enlarged sectional view of a fin of a heat exchanger according to the present invention.

FIG. 4 shows an enlarged sectional view of a plate fin. The fin base material 4 is coated with a corrosion resistant coating 5 and a hydrophilic coating 6, according to the present invention.

DETAILED DESCRIPTION OF THE INVENTION

According to the present invention, aluminum heat exchanger fins are treated with a coating composition comprising an alkali silicate A and a low-molecular-weight organic compound B having carbonyl and are thereafter dried by heating, whereby the alkali silicate A is reacted with the carbonyl-containing low-molecular-weight organic compound B to form a three-dimensional insoluble silicate coating over the surfaces of the fins. At this time, the organic compound B is converted to an organic carboxylate or organic hydroxycarboxylate and incorporated into a three-dimensional reticular polymer of silicate, so that the silicate coating formed has good stability and improved hydrophilic properties. Since the coating has enhanced flexibility to give improved ductility to the coated substrate, a fin material surface-treated as above has high shapability free of cracking, with a greatly reduced likelihood of causing wear on the shaping die.

Further when a water-soluble high-molecular-weight compound C is added to the coating composition, the compound C is incorporated into the three-dimensional polymer of silicate to give further enhanced hydrophilic properties and flexibility to the coating, rendering the coating material more shapable and less likely to cause wear to the die.

With the aluminum heat exchanger of the invention comprising fins which have the hydrophilic coating, the water drops deposited on the fin immediately collapse to spread over the fin surface in the form of a film, with the result that the water flows down and falls off the fin. The water remaining on the fin owing to surface tension also forms a thin film and therefore will not impede the flow of air. Accordingly the heat exchanger achieves a high heat exchange efficiency without the likelihood that the deposition of water drops produces increased resistance to the flow of air.

The alkali silicate A contained in the coating composition serves as the main component of the hydrophilic coating to be formed on the surface of the aluminum fin. The silicate A must be such that the $SiO_2/M_2O$ (wherein M is an alkali metal such as lithium, sodium or potassium) is at least 1. Preferably the silicate is 2 to 5 in the $SiO_2/M_2O$ ratio. If the $SiO_2/M_2O$ ratio is less than 1, the amount of $SiO_2$ is smaller relative to the alkali component, so that the alkali component produces an enhanced corrosive action on aluminum.

The low-molecular-weight organic compound B contained in the coating composition is a compound having carbonyl (>C=O) in the molecule and gives good stability, improved hydrophilic properties and flexibility to the coating of alkali silicate A.

Examples of such low-molecular-weight organic compounds B are aldehydes, esters and amides.

Exemplary of useful aldehydes are formaldehyde, acetaldehyde, glyoxal, malondialdehyde, succindialdehyde, glutardialdehyde and furfuraldialdehyde.

Examples of useful esters are fatty acid esters of monohydric alcohols such as methyl formate, ethyl acetate, methyl acetate, butyl acetate, amyl acetate and methyl propionate; fatty acid esters of polyhydric alcohols such as ethylene glycol diacetic acid ester, glycerin triacetic acid ester and ethylene glycol dipropionic acid ester; intramolecular esters such as $\gamma$-butyrolactone and $\epsilon$-caprolactone; partial esters of polyhydric alcohols such as ethylene glycol monoformic acid ester, ethylene glycol monoacetic acid ester, ethylene glycol monopropionic acid ester, glycerin monoformic acid ester, glycerin monoacetic acid ester, glycerin monopropionic acid ester, glycerin diformic acid ester, glycerin diacetic acid ester, sorbitol monoformic acid ester, sorbitol monoacetic acid ester and glycose monoacetic acid ester; monohydric alcohol esters of polybasic acids such as dimethyl succinate and dimethyl maleate; and cyclic carbonates such as ethylene carbonate, propylene carbonate and glycerin carbonate.

Examples of useful amides are formamide, dimethylformamide, acetamide, dimethylacetamide, propionamide, butyramide, acrylamide, malondiamide, pyrrolidone and caprolactam.

Of the compounds B exemplified above, water-soluble compounds are preferable in assuring uniform treatment. It is especially preferable to use aldehydes and esters. Glyoxal is desirable for giving coatings of enhanced hydrophilic properties.

The water-soluble high-molecular-weight compound C is added to the coating composition to give further improved hydrophilic properties and improved flexibility to the coating to be formed from the alkali silicate A and the low-molecularweight compound B having carbonyl.

Examples of such water-soluble high-molecular-weight organic compounds C are natural high polymers of the polysaccharide type, water-soluble natural high polymers of the protein type, anionic, nonionic or cationic water-soluble synthetic high polymers of the addition polymerization type, and water-soluble high polymers of the polycondensation type. Exemplary of useful natural high polymers of the polysaccharide type are soluble starch, carboxymethylcellulose, hydroxyethylcellulose, guar gum, tragacanth gum, xanthane gum, sodium alginate and the like. Gelatin, etc. are useful as water-soluble natrual high polymers of the protein type.

Examples of useful anionic or nonionic water-soluble high polymers of the addition polymerization type are polyacrylic acid, sodium polyacrylate, polyacrylamide, partially hydrolized products of such compounds, polyvinyl alcohol, polyhydroxyethyl acrylate, polyvinyl pyrrolidone, acrylic acid copolymer, maleic acid copolymer, and alkali metal, organic amine and ammonium salts of these polymers.

These high polymers of the addition polymerization type can be carboxymethylated or sulfonated for use as modified water-soluble synthetic high polymers.

Examples of cationic water-soluble synthetic high polymers of the addition polymerization type are polyethyleneimine, polyacrylamide as modified by Mannich reaction, diacryldimethylaluminum chloride, polyvinylimidazoline, dimethylaminoethyl acrylate polymer and like polyalkylamino (meth)acrylate, etc.

Examples of useful water-soluble high polymers of the polycondensation type are polyalkylene polyols such as polyoxyethylene glycol and polyoxyethylene oxypropylene glycol, polycondensation products of a polyamine such as ethylenediamine or hexamethyldiamine and epichlorohydrin, water-soluble polyurethane resin prepared by the polycondensation of a water-soluble polyether and a polyisocyanate, polyhydroxymethylurea resin, polyhydroxymethylmelamine resin, etc.

Of these water-soluble high-molecular-weight organic compounds C, it is preferable to use anionic watersoluble high polymers of the addition polymerization type having carboxylic acid or carboxylate group, among which polyacrylic acid, acrylic acid copolymer, maleic acid copolymer and alkali metal salts of these compounds are more preferable. Examples of useful acrylic acid copolymers and maleic acid copolymers are copolymer of acrylic acid and maleic acid, and copolymers of acrylic acid or maleic acid and methacrylic acid, methyl methacrylate, ethyl methacrylate, hydroxyethyl methacrylate, itaconic acid, vinylsulfonic acid or acrylamide.

The alkali silicate A, the low-molecular-weight organic compound B having carbonyl and the water-soluble high-molecular-weight organic compound C are used in the following proportions.

In the case of A +B, the carbonyl-containing compound B is used in an amount of 0.1 to 5 parts by weight per part by weight of the alkali silicate A.

In the case of A+B+C, 0.1 to 5 parts by weight of the compound B and 0.01 to 5 parts by weight of the compound C are used per part by weight of the silicate A.

When the coating composition contains the alkali silicate A in a smaller amount than the above ranges, a satisfactory hydrophilic coating will not be formed over the surface of aluminum. If the amount is too large, too hard a coating will be formed, resulting in poor shapability and rendering the die susceptible to wear or abrasion.

When the amount of the carbonyl-containing organic compound B is less than 0.1 part by weight per part by weight of the alkali silicate A, the compound B fails to produce the contemplated effect thereof, whereas if the amount is in excess of 5 parts by weight, the resulting coating will not have satisfactory hydrophilic properties owing to a reduction in the amount of the silicate A relative thereto.

When the amount of the water-soluble organic compound C is less than 0.01 part by weight per part by weight of the alkali silicate A, the compound C fails to produce the effect thereof, whereas if the amount exceeds 5 parts by weight, the resulting coating is liable to dissolve out into water and fails to retain sustained hydrophilic properties.

The alkali silicate A, the carbonyl-containing compound B and the water-soluble compound C are used as diluted with water. The degree of dilution needs to be determined in view of the hydrophilic properties and thickness of the coating to be formed and applicability or ease of handling.

The aluminum fins (including shaped fins and fin material before shaping) are coated with the aqueous solution of the above mixture by spraying, brushing or by being immersed in the aqueous solution.

The aluminum fins thus treated are then heated at 50° to 200° C., preferably 150° to 180° C, for 30 seconds to 30 minutes for drying, whereby a hydrophilic coating is formed over their surfaces.

When the drying temperature is below 50° C., the composition will not be made into a satisfactory coating, whereas if the temperature is over 200° C., the higher temperature will not produce any improved effect but adversely affect the aluminum substrate. Further if the heat-drying time is less than 30 seconds, the composition will not be made into a satisfactory coating, whereas if it is over 30 minutes, reduced productivity will result. When the heat-drying temperture is high, i.e. 160° to 200° C., the drying time may be as short as 30 seconds to 1 minute, but the drying time must be prolonged when the temperature is low. If dried insufficiently, the composition will not be made into a coating satisfactorily.

The hydrophilic coating is formed over the surfaces of aluminum fins in an amount of 0.1 to 10 g/m$^2$, preferably 0.5 to 3 g/m$^2$. If the amount is at least 0.1 g/m$^2$, the coating exhibits good hydrophilic properties initially. For the coating to retain further satisfactory hydrophilic properties, the amount is prefably at least 0.5 g/m$^2$. If the amount exceeds 10 g/m$^2$, the coating requires a longer drying time, and the coated material will not be shaped satisfactorily by press work, hence undesirable.

The aqueous coating composition may of course have incorporated therein known additives including inorganic corrosion inhibitors such as sodium nitrite, sodium polyphosphate and sodium metaphosphate, and organic corrosion inhibitors such as benzoic acid or salt thereof, p-nitrobenzoic acid or salt thereof, cyclohexylamine carbonate and benzotriazole.

To give the aluminum fins corrosion resistance and enhanced adhesion to the hydrophilic coating, it is desired to form a corrosion-resistant coating first on the aluminum surface by the chromate process, phosphoric acid-chromate process, boemite process, phosphoric acid process or the like and to thereafter treat the surface of the coating with the coating composition of the invention.

Further when a thin aluminum plate for forming fins is formed with the hydrophilic coating, it is desirable to form on the surface of the coating a covering layer of wax, or wax and polyvinyl alcohol or like water-soluble high-molecular compound to greatly reduce the wear on the die which is used for shaping the aluminum plate into fins of desired form.

EXAMPLES 1-9

Thin aluminum plates, 1 mm in thickness, 50 mm in width and 100 mm in length, of JIS A-1100H24 were used for forming fins.

The aluminum plate was first treated by the chromate process to form an oxide coating thereon, then coated with a coating composition comprising the components listed below, and heated at 160° C. for 10 minutes for drying, whereby a hydrophilic coating was formed over the surface of the aluminum plate. The coated aluminum plate was shaped into fins for a heat exchanger. The fins and a tube were assembled into a heat exchanger. The alkali silicate used for the composition had an $SiO_2/Na_2O$ ratio of 3.

Evaluation test

The performance of the heat exchanger fins thus obtained was evaluated by determining the hydrophilic property of the fin, shapability of the coated aluminum plate and resistance of the die to wear. The results obtained are also listed below.

The hydrophilic property was determined initially and after 3 repeated cycles of oleic acid staining test (14 hours) and running water immersion test (8 hours) which were conducted alternately, by measuring the contact angle of water on the fin.

The hydrophilic property was evaluated according to the criteria of: A . . . up to 15° in contact angle, B . . . 16° to 30°, C . . . 31° to 50°, and D . . . 51° or larger.

The shapability was checked by burring the coated aluminum plate and checking the bent portions for cracking.

The die wear resistance was checked by forming the coated aluminum plate into fins of specified shape by a die and measuring the resulting wear on the die. The less the wear, the higher is the resistance.

The shapability and the die wear resistance were evaluated according to the criteria of: A...excellent, B...good, C...poor, and D...very poor.

For comparison, thin aluminum plates which were the same as those mentioned above were coated with an aqueous solution of alkali silicate only and heated for drying to form a coating. The coated plates were tested in the same manner as above. The results are given below.

| Ex. | Coating composition (wt. %) | | | Evaluation of performance | | | |
|---|---|---|---|---|---|---|---|
| | | | | Hydrophilic property | | | Die wear |
| No. | A | B | C | Initial | After tests | Shapability | resistance |
| 1 | Alkali | Glyoxal | — | A | B | B | B |

-continued

| Ex. No. | Coating composition (wt. %) A | B | C | Evaluation of performance: Hydrophilic property Initial | After tests | Shapability | Die wear resistance |
|---|---|---|---|---|---|---|---|
| | silicate 2 | 0.8 | | | | | |
| 2 | Alkali silicate 2 | Ethylene glycol diacetic acid ester 2 | — | A | B | B | B |
| 3 | Alkali silicate 2 | γ-Butyrolactone 2 | — | A | B | B | B |
| 4 | Alkali silicate 2 | Dimethylformamide 2 | — | A | B | B | B |
| 5 | Alkali silicate 2 | Glyoxal 0.8 | Na salt of acrylic acid-acrylamide copolymer 2 | A | A | A | A |
| 6 | Alkali silicate 2 | γ-Butyrolactone 2 | Na salt of acrylic acid-vinyl acetate copolymer 2 | A | A | A | A |
| 7 | Alkali silicate 2 | Glyoxal 0.8 | Na salt of acrylic acid-hydroxyethyl methacrylate copolymer 2 | A | A | A | A |
| 8 | Alkali silicate 2 | Glyoxal 0.8 | Polyethyleneimine 2 | A | A | A | A |
| 9 | Sodium silicate | Glyoxal 0.8 | Polyoxyethaylene glycol 2 | A | A | A | A |
| Comp. Ex. | Sodium silicate | — | — | A | C | D | D |

The above table reveals that the aluminum heat exchanger fins of the invention having a hydrophilic coating have more excellent hydrophilic property than those of the comparison example. The hydrophilic property of the present fins is less prone to impairment with time, while the coated aluminum plate for forming fins according to the invention is excellent in shapability and die wear resistance. Since the present fins have an oxide coating first formed by the chromate process, they were outstanding in corrosion resistance.

What is claimed is:

1. A heat exchanger made of aluminum and comprising a tube and fins attached to the tube, the heat exchanger being characterized in that the fins are treated with a coating composition comprising an alkali silicate A a low-molecular-weight organic compound B having carbonyl and a water-soluble high-molecular-weight organic compound C and are thereafter dried by heating, whereby a hydrophilic coating is formed over the surfaces of the fins.

2. A heat exchanger as defined in claim 1 wherein the alkali silicate A contained in the coating composition is at least 1 in the ratio of $SiO_2/M_2O$ wherein M is lithium, sodium, potassium or like alkali metal, and the carbonyl-containing low-molecular-weight compound B is at least one compound selected from the group consisting of aldehydes, esters and amides, the water-soluble high-molecular-weight organic compound C being one compound selected from the group consisting of polyacrylic acid, acrylic acid copolymer, maleic acid copolymer and alkali metal salts of these compounds.

3. A heat exchanger as defined in claim 1 wherein the coating composition comprises 0.1 to 5 parts by weight of the low-molecular-weight compound B and 0.01 to 5 parts by weight of the water-soluble high-molecular-weight organic compound C per part by weight of the alkali silicate A.

4. A heat exchanger as defined in claim 3 wherein the alkali silicate A contained in the coating composition is at least 1 in the ratio of $SiO_2/M_2O$ wherein M is lithium, sodium, potassium of like alkali metal, and the carbonyl-containing low-molecular-weight compound B is at least one compound selected from the group consisting of aldehydes, esters and amides, the water-soluble high-molecular-weight organic compound C being one compound selected from the gourp consisting of polyacrylic acid, acrylic acid copolymer, maleic acid copolymer and alkali metal salts of these compounds.

* * * * *